US010905229B2

(12) United States Patent
Xu

(10) Patent No.: US 10,905,229 B2
(45) Date of Patent: Feb. 2, 2021

(54) ANTISTATIC HEALTH CARE COMB

(71) Applicant: DONGGUAN KINSON VACUUM TECHNOLOGY CO., LTD., Dongguan (CN)

(72) Inventor: Jiacai Xu, Guangdong (CN)

(73) Assignee: DONGGUAN KINSON VACUUM TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 16/232,028

(22) Filed: Dec. 25, 2018

(65) Prior Publication Data

US 2019/0174910 A1 Jun. 13, 2019

Related U.S. Application Data

(63) Continuation of application No. PCT/CN2017/089985, filed on Jun. 26, 2017.

(30) Foreign Application Priority Data

Jun. 30, 2016 (CN) ..... 2016 2 0673175 U

(51) Int. Cl.
*A46B 15/00* (2006.01)
*A45D 24/02* (2006.01)
(Continued)

(52) U.S. Cl.
CPC ..... *A46B 15/002* (2013.01); *A45D 24/02* (2013.01); *A46D 1/0223* (2013.01); *A46B 9/023* (2013.01); *A46B 2200/104* (2013.01)

(58) Field of Classification Search
CPC ..... A46B 15/002; A46B 15/0018; A46B 2200/104; A45D 24/02; A46D 1/023;
(Continued)

(56) References Cited

U.S. PATENT DOCUMENTS 3,084,700 A * 4/1963 Fischer ..... A45D 24/00 132/148
4,797,966 A * 1/1989 Fong ..... A46B 7/00 132/219

(Continued)

FOREIGN PATENT DOCUMENTS

CN 202233658 U 5/2012
CN 202407598 U 9/2012

(Continued)

OTHER PUBLICATIONS

Computer generated English translation of CN 202407598 U, Bin, Sep. 5, 2012. (Year: 2012).*

(Continued)

*Primary Examiner* — Laura C Guidotti
(74) *Attorney, Agent, or Firm* — Wayne & Ken, LLC; Tony Hom

(57) ABSTRACT

An antistatic health care comb comprises a comb body (3) which is coated with a conductive metal film (2), and the conductive metal film (2) is coated with a resin protective film (1). The two film are combined so that the conductivity of the conductive metal film (2) is partially reduced, and the original pure conductor is transformed into a composite semi-conductive structure product and has a higher charge migration rate that is typical for semi-conductive material. The friction generated charge can be guided and dissipates faster through direct contacted with the human body. Formation of static electricity is prevented, which protects the hair, makes the hair smoother when combing, and prevents curling phenomenon; the front side of the comb tooth portion has an upwardly arched airbag leather, and the airbag leather has airbag through holes (8) and a plurality of comb tooth.

10 Claims, 3 Drawing Sheets

(51) Int. Cl.
*A46D 1/00* (2006.01)
*A46B 9/02* (2006.01)

(58) Field of Classification Search
CPC .. A46D 1/0223; A46D 1/0246; A46D 1/0253; A46D 1/00
USPC ..... 15/159.1–160
See application file for complete search history.

(56) References Cited

U.S. PATENT DOCUMENTS

| | | | | |
|---|---|---|---|---|
| 8,875,717 | B2 * | 11/2014 | Murzynski | A45D 24/00 132/163 |
| 2005/0160347 | A1 * | 7/2005 | Kim | H04L 25/497 714/776 |

FOREIGN PATENT DOCUMENTS

| | | | | |
|---|---|---|---|---|
| CN | 204519707 | U | 8/2015 | |
| CN | 105380389 | A | 3/2016 | |
| CN | 206043785 | U | 3/2017 | |
| FR | 3077972 | A1 * | 8/2019 | A46B 15/00 |
| KR | 20020071055 | A | 9/2002 | |
| KR | 20030013618 | A | 2/2003 | |
| KR | 10-2016-0028049 | * | 3/2016 | A46D 1/0207 |
| WO | WO 2019/040391 | A1 * | 2/2019 | A46B 15/00 |

OTHER PUBLICATIONS

Computer generated English translation of CN 204519707 U, Ma, Aug. 5, 2015. (Year: 2015).*
Computer generated English translation of KR 10-2016-0028049 A, Park et al., Mar. 2016. (Year: 2016).*

* cited by examiner

ANTISTATIC HEALTH CARE COMB

CROSS-REFERENCE TO RELATED APPLICATIONS

This application is a continuation of International Patent Application No. PCT/CN2017/089985, filed on Jun. 26, 2017, which claims the benefit of priority from Chinese Application No. 201620673175.3, filed on Jun. 30, 2016. The entire contents of the aforementioned applications, including any intervening amendments thereto, are incorporated herein by reference.

TECHNICAL FIELD

The invention relates to a comb for combing hair, in particular to an antistatic health care comb.

BACKGROUND

When people comb their hair, friction occurs between the comb tooth and the hair, and the static electricity generated will make the hair roll and combing difficult; and the static electricity will damage the scalp, cause harm to the hair, and the hair break is more likely to occur. There are two main ideas for the design of the antistatic comb in the prior art. One is to suppress the electrification, such as using a material that contains a proper amount of moisture and is not easy to electrify to make a comb, such as a wooden comb and a horn comb; the other is to guide the charge so that the charge is not easily aggregated to form static electricity, such as humidifying antistatic, negative ion antistatic or other antistatic method using conductive materials.

For the first design, the combing experience and the price of the material have restricted the widespread promotion of such products. For example, most of the antistatic combs such as horn comb has only a single row of comb tooth, and thus the combing experience is not good enough; and the raw materials are difficult to obtain and process, resulting in expensive prices, which is difficult for ordinary consumers to consume;

For the second design, the humidifying antistatic is basically to add liquid (such as water) into the cavity of the comb head, thereby reducing the generation of static electricity. However, humidification easily leads to uncomfortable feeling, especially when the weather is cold, and the use is limited. The antistatic method using conductive material is using a conductive material to make the comb tooth, and the generated electric charge is guided by the comb tooth so that the electric charge cannot be smoothly aggregated to form static electricity. However, the comb is made entirely of a conductive material, and a conductive line is required to conduct the charge to the conductive area, which not only makes the comb expensive to manufacture, but also makes the internal structure complicated. The main shape of the comb is mostly a flat comb of a single row of comb tooth, which lacks the function of massage and health care, and also pure conductive materials also have safety hazards. In addition, there is also an injection comb that adds salt ions to the plastic material. After absorbing the moisture in the air, the moisture is attached to the surface of the comb, and when the hair is combed, the charge can be migrated. However, when the indoor humidity environment changes, that is when the air is dry and the water content is low, the ability of these combs to migration charge is greatly reduced. There is also a comb with a negative ion generator. This type of design has good antistatic function, but it is costly, and when the positive and negative ions collide, the user may be easily frightened by the squeaking sound, and the user experience is not good.

With respect to the problem that static electricity is generated during combing, existing designs are either expensive or have poor electrical conductivity, or have complicated conductive design and cannot be widely promoted. The present invention designs an antistatic health care comb, which uses a multi-layer film coated on the main body of the comb to form a product of composite semi-conductive structure which conducts electricity faster on the surface of the comb, thereby increasing the mobility of the electrons, so that the generated electric charge is more quickly guided. In this way, generation of static electricity is prevented. The conductive effect is good and the cost is lower, and it is safer and more reliable.

SUMMARY

The present invention is directed to the deficiencies in the prior art, and provides an antistatic health care comb. The comb is coated with a conductive metal film as a whole, and a protective resin film is coated on the conductive metal film. The resin skeleton body blocks some electrons that are free in the conductive metal film layer, and the combination of the two causes the conductive property of the metal film to partially decrease. Thus, the original pure conductor transforms into a product of a composite semi-conductive structure, and has a higher charge migration rate that is typical for semi-conductive material. The overall coated film forms an overall conduction, and through the grip of the human hand, the charge is quickly guided away, so that it cannot smoothly gather at the tip of the comb to form static electricity and thus cause damage to the scalp and hair.

An antistatic health care comb, comb body comprising a comb tooth portion and a grip portion, wherein outer surfaces of the grip portion and the comb tooth portion are coated with a first intermediate conductive layer, and the first intermediate conductive layer is coated with a first conductivity-reducing protective layer. The comb may be a multi-row comb or a conventional single-row flat comb, and only the grip is necessary for holding of the comb, i.e. the comb may be with or without a handle. The first intermediate conductive layer and the first conductivity-reducing protective layer form a product which conduct electricity faster, referred to as a composite semi-conductive structure. The composite semi-conductive structure allows the resistance of the surface of the comb to be within the resistance range of the semi-conductive material, and has the property of migrating charges faster of semi-conductive material.

Preferably, the grip portion and the comb tooth portion are integrally formed hollow structures, inner surfaces thereof are coated with a second intermediate conductive layer, and the second intermediate conductive layer is coated with a second conductivity-reducing protective layer. The grip portion and the comb tooth portion of the comb are hollow and have the same film-coating composite semi-conductive structure as the outer surface, which can improve the stability of the overall conduction and better realize the technical purpose of migrating charges faster.

Preferably, a front surface of a head of the comb tooth portion is provided with an opening, the opening is covered with an airbag leather, and the airbag leather is provided with airbag through holes and internally arranged with a plurality of comb tooth disposed centrally around the comb tooth portion. The airbag through holes are arranged such that the semi-closed cavity formed by the airbag leather and the comb of the hollow structure has air in and out, so that the airbag leather is better contracted and stretched according to different positions of the head, the scalp is massaged and tension is relieved.

Preferably, the airbag leather is a rubber leather, and the rubber leather that is upwardly convex fits closely with an inner wall of the opening of the head of the comb tooth; one end of the rubber leather close to the grip portion is provided with airbag through holes; inner and outer surfaces of the rubber leather are coated with the first intermediate conductive layer or the second intermediate conductive layer, which is further coated with the first conductivity-reducing protective layer or the second conductivity-reducing protective layer. Preferably, the first intermediate conductive layer and the second intermediate conductive layer are coatings of the same material, and the first conductivity-reducing protective layer and the second conductivity-reducing protective layer are preferably coatings of the same material. The rubber leather is cheap and easy to obtain, and the process of coating soft film on the rubber leather is relatively mature. Such coating can form an integral conduction with the main body of the comb, so that the electric charge generated on the comb tooth flows following the comb tooth, the air bag leather, the comb tooth and the grip and is guided away through human hand.

Preferably, a surface resistance of the composite semi-conductive structure of the first intermediate conductive layer and the first conductivity-reducing protective layer is $10^3\Omega$ to $10^{11}\Omega$; a surface resistance of the composite semi-conductive structure of the second intermediate conductive layer and the second conductivity-reducing protective layer is $10^3\Omega$ to $10^{11}\Omega$. The surface resistance tester measures that the surface resistance is within the resistance range of a semiconductor state. Since children may mistakenly insert the comb tooth into the insertion hole of the socket when playing the comb, the purpose of the design reduces the risk of electric shock for the comb made of pure conductive material, which is safer and more reliable.

Preferably, a surface resistance of the composite semi-conductive structure of the first intermediate conductive layer and the first conductivity-reducing protective layer is $10^4\Omega$ to $10^9\Omega$; a surface resistance of the composite semi-conductive structure with the second intermediate conductive layer and the second conductivity-reducing protective layer is $10^4\Omega$ to $10^9\Omega$. The surface resistance tester measures that the surface resistance is within the resistance range of a semiconductor state. Since children may mistakenly insert the comb tooth into the insertion hole of the socket when playing the comb, the purpose of the design reduces the risk of electric shock for the comb made of pure conductive material, which is safer and more reliable. When the surface resistance of the composite semi-conductive structure is in this range, the performance of rapid conduction is greatly improved; the surface resistance is determined by factors such as the film layer material of the composite semi-conductive structure, the thickness of the film layer, and the curvature of the surface of the comb.

Preferably, a plurality of hemispherical protrusions are distributed on front and back sides of the grip portion and the comb tooth portion. Arrangement of the protrusions not only can bring the massage health care effect when pressed, but more importantly, after increasing the thickness of the conductivity-reducing protective layer, the free charge passing through the resin gap is reduced, and the shape of the protrusions can change the surface charge density and cause more free charge on the surface of the conductive layer to migration. In this way, the surface resistance of the comb is reduced to be closer to the resistance range of semiconductor, and enhancing the antistatic effect.

Preferably, the first intermediate conductive layer and the second intermediate conductive layer are made of the same material, and each is a layer of conductive metal film or a conductive alloy film coated on a surface of the comb body, with a film thickness of not less than 2 μm. When the film thickness of the conductive metal film or the conductive alloy film is less than 2 μm, the formed composite product has poor electrical conductivity, which is characterized by low speed or poor stability. To some extent, as the film thickness increases, the conductive effect also is enhanced.

Preferably, the first conductivity-reducing protective layer and the second conductivity-reducing protective layer are made of the same material, each of which is a transparent resin protective film, with a film thickness of not less than 3 μm. The resin protective film is disposed on the one hand to form a composite semi-conductive structure with a conductive metal film or a conductive alloy film, which partially reduces conductivity performance, but has a higher conductive speed; on the other hand, it also prevents oxidation of the conductive metal film or the conductive alloy film, ensures electrical conductivity and durability, and also extends the life span of the comb.

Preferably, the conductive metal film or the conductive alloy film and the resin protective film are coated by electroplating or vacuum sputter plating, and the transparent resin protective film can be colored using different toners. The transparent resin protective film is easy to be colored, and different coloring agents can be added during post-processing to produce a comb of any color, and the consumer has more options regarding color of the comb. Color of the comb is no longer limited to a single color of the ordinary antistatic comb, which satisfies the needs of the market.

The beneficial effects of the invention are:

With respect to prior art, the antistatic performance of the comb integrally formed by using the conductive material is optimal, but it is costly and the manufacturing is difficult; as to the antistatic health care comb of the present invention, the surface of the grip portion and the comb tooth portion of the comb is covered with a layer of conductive metal film and a layer of resin protective film. The resin skeleton of the resin protective film layer blocks some electrons released in the conductive metal film layer, and the combination of the two causes the conductive property of the metal film to partially decrease. The pure conductor is transformed into a product of a composite semi-conductive structure, and has a higher charge migration rate that is typical for semi-conductive material. The overall coated film forms an overall conduction, and through the grip of the human hand, the charge is quickly guided away, so that it cannot smoothly gather at the tip of the comb to form static electricity and thus cause damage to the scalp and hair. Formation of static electricity is prevented, which protects the hair, makes the hair smoother when combing, and prevents curling phenomenon. Secondly, the present invention also has a certain massage health care function. Since there is a certain pressing action when combing the hair, the airbag through holes on the airbag leather will suck air from and discharge an appropriate amount of air into the cavity during the hair combing process, which causes the airbag leather to fluctuate, so that the combing of the multi-circle comb tooth can be changed according to the different contact positions of the head. In this way, the scalp feels comfortable and has no pressure feeling, and the defect of hard feeling of the single-row comb tooth is overcome, thereby achieving the effect of massage health care.

Figure 1:
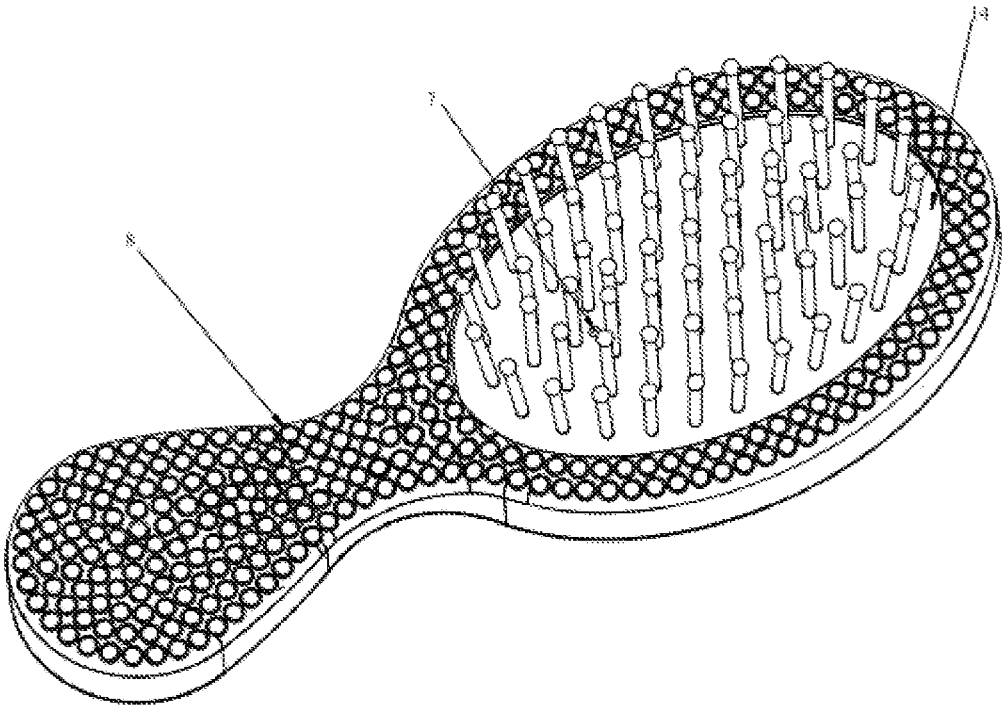
FIG. 1 is a perspective view of a comb with multiple rows of comb tooth.
Figure 2:
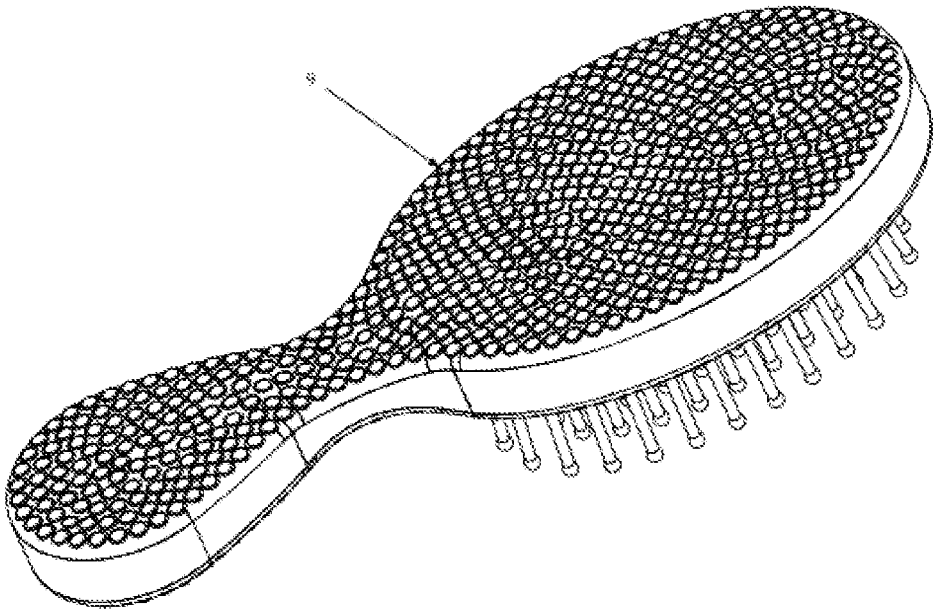
FIG. 2 is another perspective view of a comb with multiple rows of comb tooth.
Figure 3:
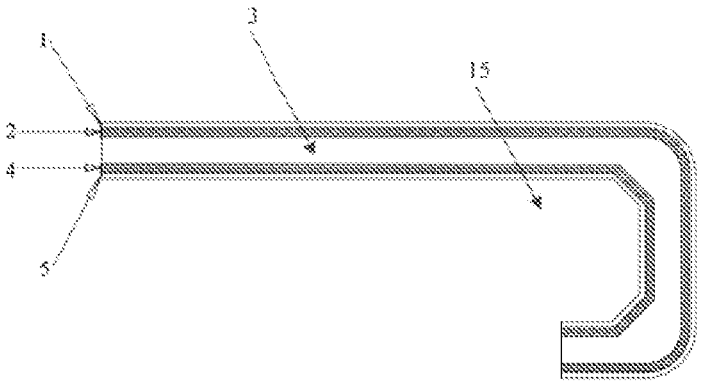
FIG. 3 is a schematic view showing the coating structure of the antistatic health care comb.
Figure 4:
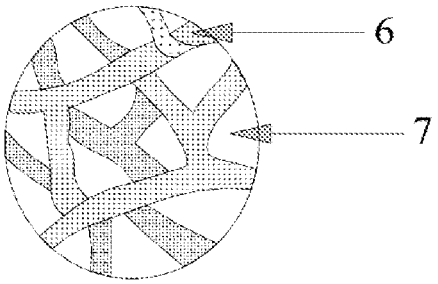
FIG. 4 is an enlarged view of the resin structure.
Figure 5:
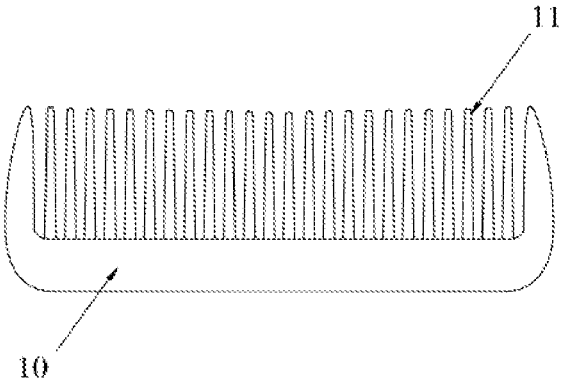
FIG. 5 is a schematic view of a flat comb of a single row of comb tooth without a handle.
Figure 6:
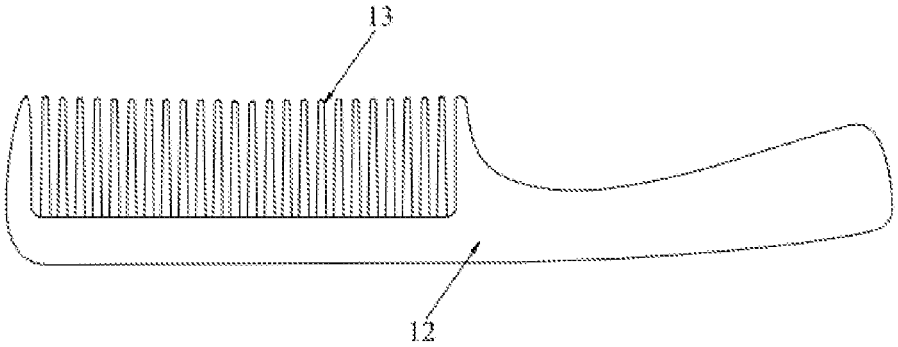
FIG. 6 is a schematic view of a flat comb of a single row of comb tooth with a handle.
Figure 7:
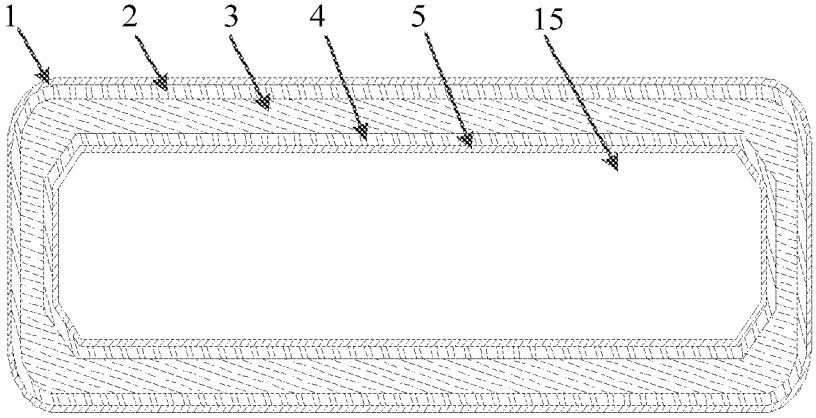
FIG. 7 is a cross sectional view of the antistatic health care comb.

The reference numerals in the drawing are: 1, first conductivity-reducing protective layer, 2, first intermediate conductive layer, 3, comb body, 4, second intermediate conductive layer, 5, second conductivity-reducing protective layer, 6, resin skeleton body, 7, resin gap, 8, airbag through hole, 9, hemispherical body protrusion, 10, grip portion of a flat comb without a handle, 11, comb tooth portion of a flat comb without a handle, 12, grip portion of a flat comb with a handle, 13, comb tooth portion of a flat comb with a handle, 14, airbag leather, 15, hollow structure.

DETAILED DESCRIPTION OF EMBODIMENTS

The invention will now be further described with reference to these drawings and embodiments.

As shown in the drawings, an antistatic health care comb has a comb body 3 and a grip portion; the grip portion, the comb portion and the body of the comb are made of plastic or other non-conductive material.

The grip portion of the comb, the comb tooth portion and the outer surface of the comb tooth are all coated with a first intermediate conductive layer 2, and a first conductivity-reducing protective layer 1 is coated on the first intermediate conductive layer 2. As shown in the drawings, the comb of the present invention may be a comb having a plurality of rows of comb tooth or a flat comb of a conventional single row comb, as long as a grip portion is provided for holding the comb. That is, the comb may be provided with or without a handle (the grip portion 10 of the flat comb without a handle, the comb portion 11 of the flat comb without a handle, the grip portion 12 of the flat comb with a handle, the comb tooth portion 13 of the flat comb with a handle). The first intermediate conductive layer 2 of the present invention and the first conductivity-reducing protective layer 1 form a product which conducts electricity faster, which is called a composite semi-conductive structure. The composite semi-conductive structure allows the surface resistance of the comb to be within the resistance range of semi-conductive material, and has the property that the semi-conductive material can migration charges faster.

The grip portion and the comb tooth portion are integrally formed hollow structures 15, inner surfaces thereof are coated with a second intermediate conductive layer 4, and the second intermediate conductive layer 4 is coated with a second conductivity-reducing protective layer 5. The grip portion and the comb tooth portion of the comb are hollow and have the same film-coating composite semi-conductive structure as the outer surface, which can improve the stability of the overall conduction and better realize the technical purpose of migrating charges faster.

The grip portion of the comb and the inner and outer surfaces of the comb tooth portion are coated with a first intermediate conductive layer 2 or a second intermediate conductive layer 4, and the first intermediate conductive layer 2 and the second intermediate conductive layer 4 are actually a layer of conductive metal film, such as a copper film, an aluminum film or an alloy film, or also a silver film; according to different product positioning, a common comb product uses a copper film, and a high-end comb product uses a metal film such as a silver film or the like which has better conductivity but higher cost. That is, as to the product itself, the metal film layer is not limited to copper, but aluminum, nickel, silver, gold or alloy can be selected according to the requirements for the product, and different intermediate plating layers can be used; the comb of the present invention can have multiple rows of comb tooth or can be a conventional flat comb with a single row of comb tooth.

A front surface of the head of the comb tooth portion of the comb is provided with an elliptical or circular opening, and the opening is provided with an airbag leather slightly arched upward. The airbag leather is provided with airbag through holes and internally arranged with a plurality of comb tooth disposed centrally around the comb tooth portion. The comb tooth are fixedly connected to the airbag leather, but since the airbag leather is made of a flexible material, such as rubber leather, the comb tooth can swing on the airbag leather; the airbag through holes 8 are arranged such that the semi-closed cavity formed by the airbag leather and the comb of the hollow structure has air in and out, so that the airbag leather is better contracted and stretched according to different positions of the head. In addition, since the comb tooth are able to swing, the scalp is massaged and tension is relieved.

The airbag leather used in the present invention is preferably a rubber leather, and the rubber leather that is upwardly convex fits closely with an inner wall of the opening of the head of the comb tooth; one end of the rubber leather close to the grip portion is provided with airbag through holes 8; inner and outer surfaces of the rubber leather are coated with the first intermediate conductive layer 2 or the second intermediate conductive layer 4, which is further coated with the first conductivity-reducing protective layer 1 or the second conductivity-reducing protective layer 5. Preferably, the first intermediate conductive layer 2 and the second intermediate conductive layer 4 are coatings of the same material, and the first conductivity-reducing protective layer 1 and the second conductivity-reducing protective layer 5 are preferably coatings of the same material. That is, when the materials are the same, the two are the same thing, but the descriptions of the definitions are different. Different from the existing conductive rubber leather modified with a conductive agent, the rubber leather of the present invention may adopt a natural rubber leather without adding a modification process, and then a layer of a conductive metal soft film and a resin protective soft film are directly coated thereon. The choice of metal and resin is consistent with the metal of the conductive metal film and the resin of the resin protective film of the described above, and belongs to the same coated product. The rubber leather is cheap and easy to obtain, and the process of coating soft film on the rubber leather is relatively mature. Such coating can form an integral conduction with the main body of the comb, so that the electric charge generated on the comb tooth flows following the comb tooth, the air bag leather, the comb tooth and the grip and is guided away through human hand.

A surface resistance of the composite semi-conductive structure of the first intermediate conductive layer 2 and the first conductivity-reducing protective layer 1 is $10^3\Omega$ to $10^{11}\Omega$; a surface resistance of the composite semi-conductive structure of the second intermediate conductive layer 4 and the second conductivity-reducing protective layer 5 is $10^3\Omega$ to $10^{11}\Omega$. According to Ohm's law, the greater the resistance, the greater the ability to block current. In other words, the smaller the resistance, the stronger the ability to migration charge. Conductors, semiconductors, and insulators are usually distinguished by resistivity; the so-called resistivity, that is, the ratio of the product of the resistance under 20° C. and the cross-sectional area to the length, which is independent of factors such as the length and cross-sectional area of the conductor, and which is an electrical property of the conductive material itself, determined by the material of the conductor and related to temperature; through the composite semi-conductive structure of the present application, the resistivity of the surface of the original comb conductive layer is changed, and the resistance of the surface of the original conductive layer is also changed. Since the surface resistance is simple and easy to understand, and the hand-held surface resistance tester is more convenient to carry and measure than the benchtop resistivity tester, the change in surface resistance is used in the explanation to illustrate how the composite semi-conductive structure formed by coating the surface of the comb with a multi-layer film can prevent static electricity. It needs to be clear that the conductivity and charge migration properties are different. The conductivity of a metal is better than that of a semiconductor because the internal field strength of the metal body is uniform, while reverse charge is induced inside the semiconductor and electrical displacement occurs to form a reverse field. Therefore, the current through the metal is stronger than that of the semiconductor, that is, the conductivity is better; while the semiconductor has holes and electrons, the mobility of the charge is higher than that of the metal body, that is, the directional movement speed of the charge in the semiconductor is faster, and the charge migration can be guided away more quickly. Therefore, the use of the composite semi-conductive structure of the comb surface of the present application can achieve the prevention of static electricity generation during combing.

More preferably, a surface resistance of the composite semi-conductive structure of the first intermediate conductive layer 2 and the first conductivity-reducing protective layer 1 is $10^4\Omega$ to $10^9\Omega$; more preferably, a surface resistance of the composite semi-conductive structure with the second intermediate conductive layer 4 and the second conductivity-reducing protective layer 5 is $10^4\Omega$ to $10^9\Omega$. The surface resistance tester measures that the surface resistance is within the resistance range of a semiconductor state. Because the comb is a household item, can be placed anywhere, and young children may reach it at any time and use it as a toy. Therefore, the surface of the comb body 3 is designed as a composite semi-conductive structure to partially reduce the conductive performance, so that the current through the comb is reduced, thereby reducing the risk of electric shock of the children who hold the comb to touch the power socket, and the use is safer and more reliable. When the surface resistance of the composite semi-conductive structure is in this range, the performance of rapid conduction is greatly improved; the surface resistance is determined by factors such as the film layer material of the composite semi-conductive structure, the thickness of the film layer, and the curvature of the surface of the comb.

A plurality of hemispherical protrusions 9 are distributed on front and back sides of the grip portion and the comb tooth portion. Arrangement of the protrusions not only can bring the massage health care effect when pressed; more importantly, according to Gauss's law, in the electrostatic field, the electric field intensity flux passing through any closed curved surface is only the algebra of the electric charge in the closed curved surface, and equals to the algebraic sum of the charge of the closed surface divided by the permittivity in vacuum. In other words, when there is charge buildup on the surface of the conductor, the charge density is related to the shape of the conductor surface. The charge density in a concave portion is close to zero, and is small in a flat portion and largest in a tip portion. Considering that the surface of the comb body 3 will contact the human hand or the scalp, it is arranged as a convex semi-circular sphere instead of blindly as sharp protrusions for faster charge migration, and this shape is very easy to achieve by the mold. Therefore, after increasing the thickness of the conductivity-reducing protective layer, the free charge passing through the resin gap is reduced, and the shape of the protrusions can change the surface charge density and cause more free charge on the surface of the conductive layer to migration. In this way, the surface resistance is reduced (actually the surface resistivity is reduced) to be closer to the resistance range of semiconductor, and enhancing the antistatic effect.

The first intermediate conductive layer 2 and the second intermediate conductive layer 4 are made of the same material, and each is a layer of conductive metal film or a conductive alloy film coated on a surface of the comb body 3, with a film thickness of not less than 2 μm. When the film thickness of the conductive metal film or the conductive alloy film is less than 2 μm, the formed composite product has poor electrical conductivity, which is characterized by low speed or poor stability. To some extent, as the film thickness increases, the conductive effect also is enhanced. When considering the cost, film material and film thickness can be appropriately selected according to the positioning of the product.

The first conductivity-reducing protective layer 1 and the second conductivity-reducing protective layer 5 are made of the same material, each of which is a transparent resin protective film, with a film thickness of not less than 3 μm. The resin protective film is disposed on the one hand to form a composite semi-conductive structure with a conductive metal film or a conductive alloy film, which partially reduces conductivity performance, but has a higher conductive speed; on the other hand, it also prevents oxidation of the conductive metal film or the conductive alloy film, ensures electrical conductivity and durability, and also extends the life span of the comb. Since the resin protective film is an ionic macroporous weak acid acrylate varnish or the like, the resin itself has a plurality of resin gaps 7 between the resin skeleton bodies 6, and the free charge on the first or second intermediate conductive layer can pass through the resin gaps 7 and be released to the surface of the comb to achieve the function of partially reducing the conductivity without lost of the conductivity, and the product of the composite semiconductor structure formed by the conductive metal film or the conductive alloy film has a property of faster charge migration as semiconductor.

In order to ensure that the surface resistance of the composite semi-conductive structure is in the semiconductor range, and the semiconductor has excellent charge migration performance, the film thickness of the conductive metal film or the conductive alloy film is not less than 2 μm, and the film thickness of the resin protective film is not less than 3 μm. At a room temperature of 25° C. and a relative humidity of 65 degrees, the tested surface resistance of the comb is required to be between $10^3$ and $10^{11}\Omega$, more preferably between $10^4$ and $10^9\Omega$. At the same time, the thickness of the protective film can be appropriately increased to increase the durability and life span of the product.

The conductive metal film or the conductive alloy film and the resin protective film are coated by electroplating or vacuum sputter plating. Comparatively, the existing horn comb or the conductive carbon fiber comb is involved with too many processes and is difficult to be colored in the molding process, and the color is monotonous, which is difficult to meet the aesthetic requirements of different customers; the surface of the comb of the present invention is a transparent resin protective film, and different coloring agents can be added during post-processing to produce a comb of any color. In addition, the transparent resin protective film is easy to be colored, and a comb of any color can be manufactured to satisfy the needs of the market.

Variations and modifications of the above-described embodiments may also be made by those skilled in the art in light of the above disclosure. Therefore, the present invention is not limited to the specific embodiment disclosed and described, and the modifications and variations of the invention are intended to fall within the scope of the appended claims. In addition, although some specific terms are used in the specification, these terms are merely for convenience of description and do not impose any limitation on the present invention.

What is claimed is:

1. An antistatic health care comb, comprising a comb body with a comb tooth portion and a grip portion, wherein outer surfaces of the grip portion and the comb tooth portion are coated with a first intermediate conductive layer, and the first intermediate conductive layer is coated with a first conductivity-reducing protective layer, the grip portion and the comb tooth portion are integrally formed hollow structures, inner surfaces thereof are coated with a second intermediate conductive layer, and the second intermediate conductive layer is coated with a second conductivity-reducing protective layer.

2. The antistatic health care comb according to claim 1, wherein a front surface of a head of the comb tooth portion is provided with an opening, the opening is covered with an airbag leather, and the airbag leather is provided with airbag through holes and a plurality of comb tooth.

3. The antistatic health care comb according to claim 2, wherein the airbag leather is a rubber leather, and the rubber leather that is upwardly convex fits closely with an inner wall of the opening of the head of the comb tooth; one end of the rubber leather close to the grip portion is provided with airbag through holes; inner and outer surfaces of the rubber leather are coated with the first intermediate conductive layer or the second intermediate conductive layer, the first intermediate conductive layer is further coated with the first conductivity-reducing protective layer, and the second intermediate conductive layer is further coated with the second conductivity-reducing protective layer.

4. The antistatic health care comb according to claim 3, wherein a surface resistance of a composite semi-conductive structure of the first intermediate conductive layer and the first conductivity-reducing protective layer is $10^3\Omega$ to $10^{11}\Omega$; a surface resistance of a composite semi-conductive structure of the second intermediate conductive layer and the second conductivity-reducing protective layer is $10^3\Omega$ to $10^{11}\Omega$.

5. The antistatic health care comb according to claim 4, wherein a surface resistance of the composite semi-conductive structure of the first intermediate conductive layer and the first conductivity-reducing protective layer is $10^4\Omega$ to $10^9\Omega$; a surface resistance of the composite semi-conductive structure with the second intermediate conductive layer and the second conductivity-reducing protective layer is $10^4\Omega$ to $10^9\Omega$.

6. The antistatic health care comb according to any one of claims 1, 2, 3, 4, or 5, wherein a plurality of hemispherical protrusions are distributed on front and back sides of the grip portion and the comb tooth portion.

7. The antistatic health care comb according to claim 1, wherein the first intermediate conductive layer and the second intermediate conductive layer are made of the same material, and each is a layer of conductive metal film or a conductive alloy film coated on a surface of the comb body, with a film thickness of not less than 2 μm.

8. The antistatic health care comb according to claim 1, wherein the first conductivity-reducing protective layer and the second conductivity-reducing protective layer are made of the same material, each of which is a transparent resin protective film, with a film thickness of not less than 3 μm.

9. The antistatic health care comb according to claim 7, wherein the conductive metal film or the conductive alloy film is coated by electroplating or vacuum sputter plating.

10. The antistatic health care comb according to claim 8, wherein the resin protective film is coated by electroplating or vacuum sputter plating, and the transparent resin protective film can be colored using different toners.

* * * * *